United States Patent [19]

Brown et al.

[11] 4,251,190

[45] Feb. 17, 1981

[54] WATER RING ROTARY AIR COMPRESSOR

[75] Inventors: Charles D. Brown, Raymond; Cole N. Plummer, South Casco; Roger N. Tripp, Northwindham; Maurice E. Fernald, Casco, all of Me.

[73] Assignee: General Signal Corporation, New York, N.Y.

[21] Appl. No.: 10,476

[22] Filed: Feb. 8, 1979

[51] Int. Cl.[3] ..... F04C 19/00

[52] U.S. Cl. ..... 417/68; 417/310; 417/DIG. 1

[58] Field of Search ..... 417/68, 69, DIG. 1, 417/310, 307, 440

[56] References Cited

U.S. PATENT DOCUMENTS

| | | | |
|---|---|---|---|
| 2,871,562 | 2/1959 | Kern | 417/DIG. 1 |
| 2,966,860 | 1/1961 | Maynard | 417/DIG. 1 |
| 3,145,629 | 8/1964 | Gottzmann | 417/DIG. 1 |
| 3,366,314 | 1/1968 | Schroder | 417/68 |
| 3,404,634 | 10/1968 | Connelly | 417/310 X |
| 3,712,764 | 1/1973 | Shearwood | 417/68 |
| 3,713,749 | 1/1973 | Fitch | 417/68 X |
| 3,806,283 | 4/1974 | Leverett | 417/310 |
| 3,894,812 | 7/1975 | Huse | 417/68 |

*Primary Examiner*—Carlton R. Croyle
*Assistant Examiner*—Edward Look
*Attorney, Agent, or Firm*—Oblon, Fisher, Spivak, McClelland & Maier

[57] ABSTRACT

An improved water ring rotary air compressor in which the rotor assembly has a cylindrical bore while the port head includes a cylindrical port sleeve, made from a high lubricity thermoplastic material, which fits within the bore. The use of a high lubricity thermoplastic port sleeve eliminates the need for shimming the port head following an overhaul of the compressor. The port sleeve includes a plurality of longitudinal slots which eliminate cavitation during start up under pressure. A needle valve built into the manifold allows bypass of a portion of the discharge air into the air inlet. Adjustment of the needle valve permits the maintenance of constant air flow as the compressor becomes worn.

2 Claims, 4 Drawing Figures

WATER RING ROTARY AIR COMPRESSOR

BACKGROUND OF THE INVENTION

1. Field of the Invention

This invention relates to compressors and, more particularly to water ring rotary air compressors.

2. Description of the Prior Art

Rotary air compressors are well known and commonly used in the compressor art. Also well known are water ring rotary air compressors in which a water ring is provided for the purpose of sealing the compressor and acting as a pumping fluid. However, these relatively low flow water ring rotary air compressors, for example, the compressors manufactured by the Nash Engineering Co. of South Norwalk, Conn., suffer from several shortcomings. First, the prior art water ring rotary air compressors, such as the Nash compressor, were of an all metal construction. The port sleeve, which was typically bronze, was cone shaped and mated with a cone shaped bore of the rotor assembly with very close tolerances. The all metal construction, coupled with the cone shape of the sleeve and bore, resulted in the need for shimming of the port head so as to produce the desired port head clearance and avoid metal to metal contact when replacing the port head or rotor assembly during overhaul of the compressor. Such shimming was virtually impossible in the field and required precision alignment tools. It has been proposed to utilize a removable cylindrical port sleeve made from plastic material on the port head, the port sleeve mating with the bore of the rotor assembly. It was believed that the cylindrical plastic port head would be worn to proper clearance by the metal bore and would not require shimming. However, in practice, it was found that the plastic port sleeve material was worn down at an excessive rate and required replacement often.

Second, the prior art compressors lacked means for adjusting the air flow rate. As the compressors became worn, their air flow rate decreased. This variation in air flow required adjustments of the associated equipment of compensate for output differences from one compressor to another or rebuilding of the compressor to restore the original air flow.

Third, in the prior art compressors, cavitation often resulted during compressor start up under pressure.

SUMMARY OF THE INVENTION

It is an object of this invention to provide a water ring rotary air compressor which does not require shimming of the port head during replacement of the port head or rotor assembly.

It is another object of this invention to provide a water ring rotary air compressor having a high lubricity thermoplastic port sleeve.

It is another object of this invention to provide a water ring rotary air compressor having excess air flow capacity and air flow adjustment means to maintain a constant air flow as the compressor becomes worn.

It is another object of this invention to provide a port sleeve which eliminates cavitation during compressor start up under pressure.

More particularly, the present invention consists of a water ring rotary air compressor made up of a compressor housing, a motor driven rotor assembly within the housing, a port head and a separate manifold. The port head includes an extension which may be cylindrical having a high lubricity thermoplastic port sleeve press fit about its circumferential periphery. Both the extension and port sleeve are normally located within a central bore of the rotor assembly. Since the sleeve is made from a relatively soft thermoplastic material, it is quickly worn to the proper radial clearance during use, thereby eliminating the need for shimming of the head during replacement. However, since the thermoplastic material is of high lubricity, the rate of wear is not excessive.

Further, the port sleeve contains longitudinal slots. This configuration of the port sleeve reduces or eliminates cavitation during compressor start up under pressure.

The manifold of the compressor contains a needle valve in a bore connected between the inlet and discharge ports which selectively allows bypass of the compressed air back to the inlet port. The compressor is designed to have excess air flow capacity and the needle valve is initially set to allow partial bypass. As the compressor becomes worn, the needle valve is gradually closed so as to reduce the air bypass rate and provide constant air flow from the discharge end. Such a feature was not possible in the prior art compressors since they were not designed to initially provide excess air flow capacity.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like corresponding parts throughout the several views and wherein.

DETAILED DESCRIPTION OF THE PREFERRED EMBODIMENTS

Figure 2:
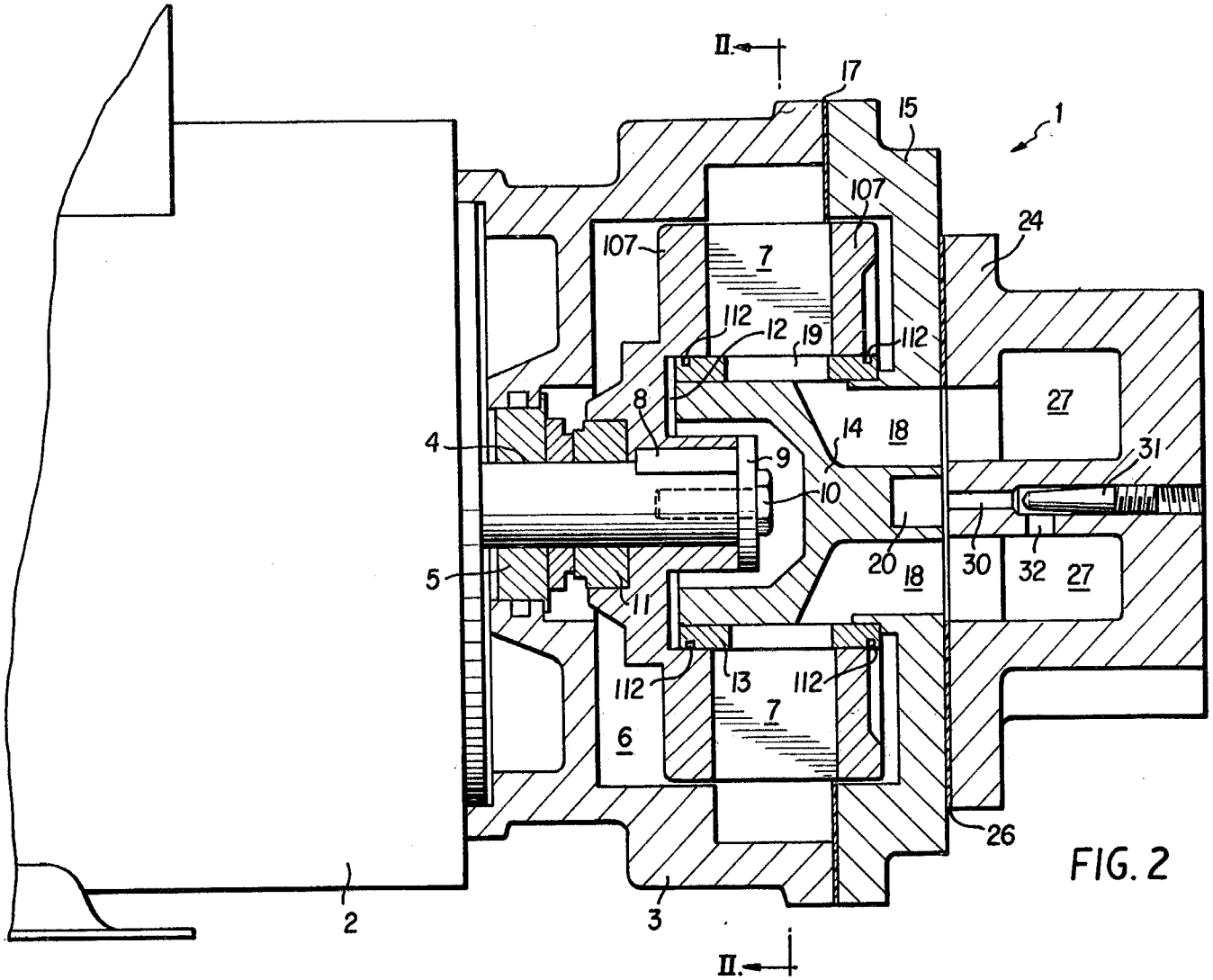
FIG. 2 is a cross-sectional view taken along line I—I of FIG. 1.
Figure 3:
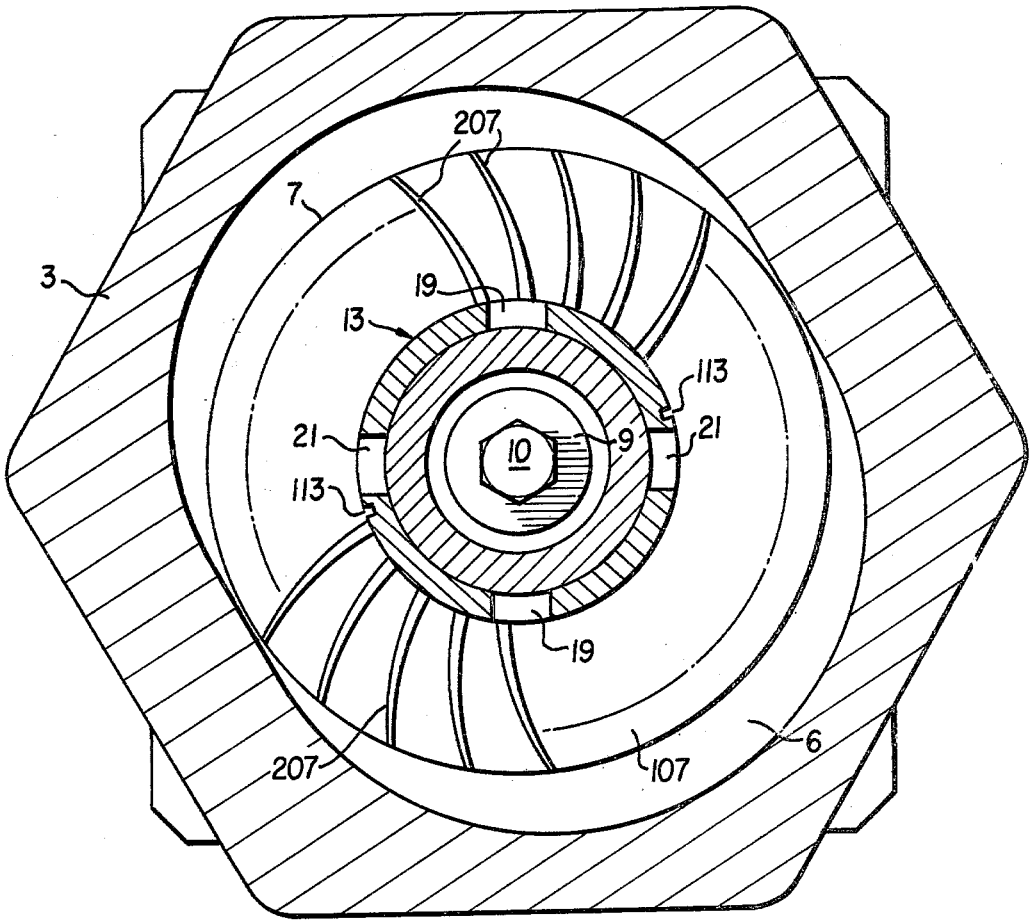
FIG. 3 is a cross-sectional view taken along line II—II of FIG. 2.

The preferred embodiment of the invention will now be described with reference to the drawings. The water ring rotary air compressor is shown generally at 1 (FIG. 2) and consists of an open ended cylindrical compressor housing 3 having one end secured to an electric motor 2 by appropriate means such as bolts 23. A motor shaft 4 axially extends through the shaft seal assembly 5 and into an eccentric bore 6 (FIG. 3) of the housing 3 for providing motive power to the rotor assembly 7. The rotor assembly 7, which includes shrouds 107 and blades 207, is axially inserted into the eccentric bore 6 and is keyed against rotation on shaft 4 by key 8. The rotor assembly is axially secured on shaft 4 by sealing plate 9 and rotor screw 10. Seal seat 11, secured to the rotor assembly 7 adjacent the shaft seal assembly 5, axially seats the shaft seal assembly 5 so as to maintain the shaft seal.

The rotor assembly 7 which is made of a metallic material, includes a cylindrical central bore 12 into which a cylindrical port sleeve 13 made from a high lubricity thermoplastic material may be inserted. The port sleeve is press fit upon a cylindrical extension 14 of port head 15. The port head is secured to, the covers, the other end of the compressor housing 3 through bolts 16, alignment pins 32 and appropriate gasket means 17. Extension 14 includes air inlet passages 18 communicating with the rotor assembly 7 through apertures 19 in the port sleeve 13. Extension 14 also includes compressed air discharge passages which are identical to, and oriented 90° from, inlet passages 18 and which are connected at 20. The discharge passages communicate with the rotor assembly 7 through aperatures 21 in the port sleeve. Drain cock 22, on the port head 15, may be used to drain the water ring when appropriate.

Rotation of the rotor assembly 7, creates a water ring adjacent the periphery 106 of the eccentric bore 6 of the housing due to centrifugal force. The height of the water ring in the space between any two blades 207 continuously reciprocates as a result of the eccentric shape of the bore 6 and the rotation of the rotor assembly 7, thereby pumping and compressing air in a manner well known in the art of water ring compressors. The basic structure and manner of operation of water ring compressors is illustrated in U.S. Pat. No. 1,718,294 and U.S. Pat. No. 1,847,586, the subject matter of both of which is hereby incorporated by reference.

Figure 1:
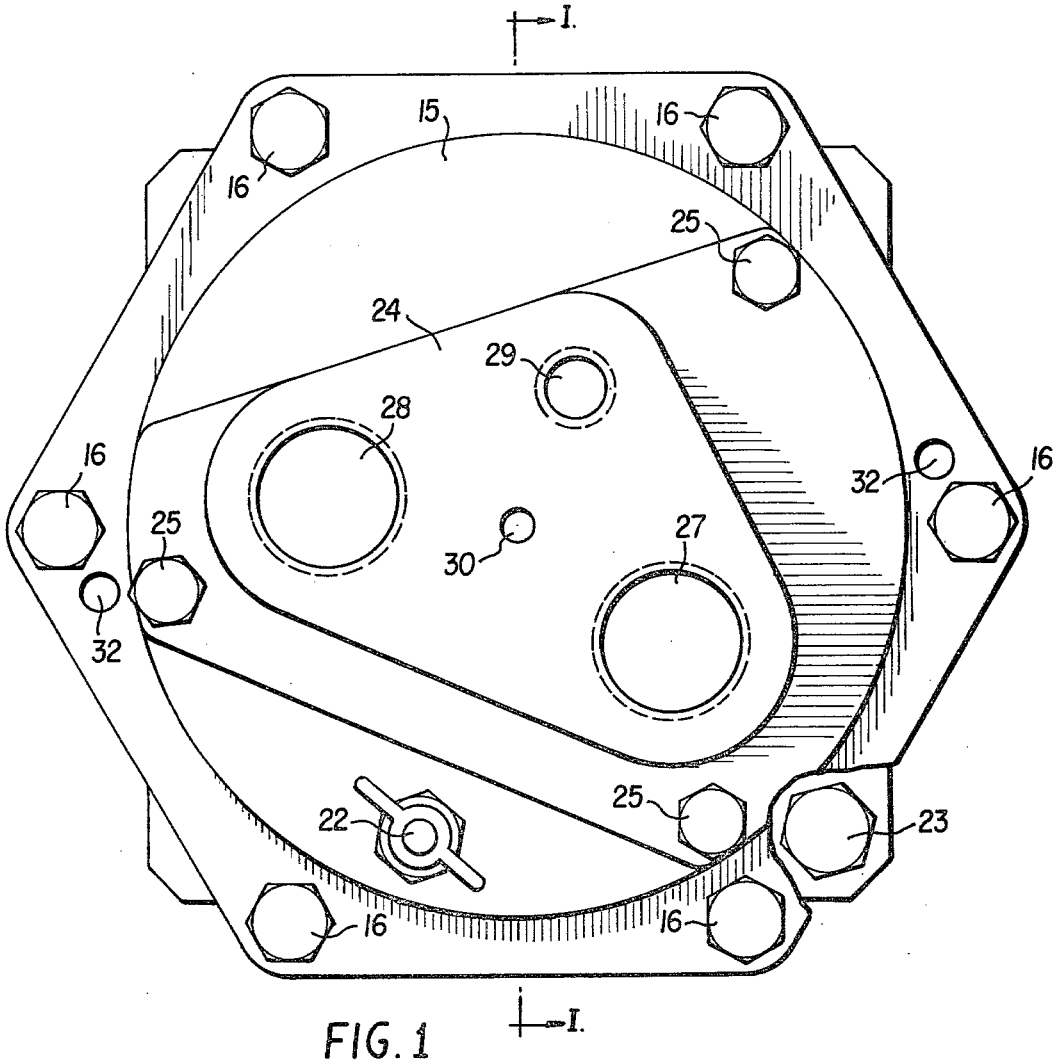
FIG. 1 is an end view of the preferred embodiment of the compressor of the invention.
Figure 4:
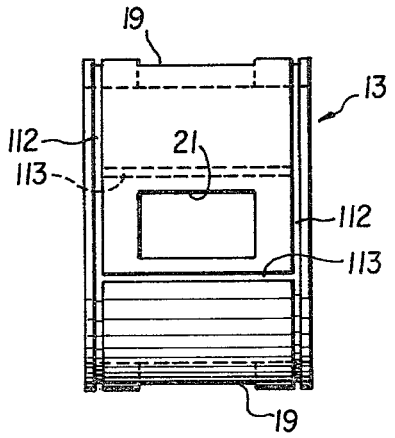
FIG. 4 is a longitudinal view of the port sleeve.

The port sleeve 13 is made from a high lubricity thermoplastic material such as heat treated Teflon and is press fit or otherwise secured to the extension 14. The heat treated Teflon may be impregnated with mica or glass. As may be seen in FIG. 4, the outer surface of the port sleeve 13 includes a circumferential groove 112 extending partly through the radial thickness of the port sleeve adjacent each longitudinal end. In addition the outer surface of the port sleeve contains a plurality of, and preferably two, longitudinal slots 113 which act to reduce or eliminate cavitation during start up of the compressor under pressure. The longitudinal slots 113 extend partly through the radial thickness of the port sleeve 13 and run from one circumferential groove 112 to the other adjacent the aperatures 19, preferably at 180° intervals. The precise manner in which the slots 113 operate to reduce or eliminate cavitation is not fully understood, however, it is thought that the slots permit the bypass of compressed air to a lower pressure portion of the compressor and that this action contributes to the cavitation reduction.

A manifold 24 is secured to the port head 15 by convenient means such as the three bolts 25 and gasket 26. Manifold 24 includes air inlet port 27 communicating with air inlet passages 18 and connectable to an appropriate source of air, and compressed air discharge port 28 communicating with the compressed air discharge passages at 20 and connectable to an appropriate means for using compressed air. Manifold 24 also includes water intake port 29 which communicates with air inlet passages 18 and is connectable to a source of water for forming the water ring.

An axial bore 30 passes through manifold 24 and communicates air inlet port 27 with the air discharge passage at 20 through aperature 31 to bypass air from the discharge side to the inlet side of the compressor. The bore 30 contains a needle valve 31 which may be manipulated to adjust the bypass rate. The compressor is preferably designed so as to posses 5% to 8% excess flow capacity for any desired use. The needle valve is initially set to allow sufficient air flow bypass to provide appropriate discharge air flow for the desired use. As the compressor gradually becomes worn and its flow capacity decreases, the bypass is progressively closed so as to maintain a constant discharge air flow from the compressor.

When replacement of the rotor assembly 7 or port sleeve 13 becomes necessary, the manifold 24 may be removed from the port head 15 by removing the bolts 25. It is not necessary to disconnect the lines to the air inlet port 27, air discharge port 28 and water intake port 29 because the manifold does not normally require servicing. The port head 15 may therefore be quickly and easily reached for servicing without the necessity of disconnecting any fluid lines.

Subsequent removal of the port head 15 exposes the port sleeve 13 and the rotor assembly 7. The port sleeve may be removed from the port head and a new port sleeve press fit or otherwise inserted upon the port head extension 14. The rotor assembly 7 may also be replaced with a new rotor assembly.

In prior art compressors, the bore and port head were both conical and constructed of a metallic material. Since mating tolerances between the bore and port head were close, and since the clearance between the conical parts was affected by the relative axial position of the conical port head with respect to the housing, it was necessary to shim the port head and to use precision alignment tools to position the port head and to prevent metal on metal contact between the rotor assembly and port head following replacement of the rotor assembly or port head. However, in the compressor of the present invention the bore 12 of the rotor assembly 7 is cylindrical and mates with the radial surface of a cylindrical high lubricity thermoplastic port sleeve 13. As a result, the axial clearance between the port sleeve and the rotor assembly is not critical. Further, since the port sleeve 13 is made from a relatively soft thermoplastic material, it is quickly worn to the proper radial clearance by the rotor assembly during use. However, since the thermoplastic material is of high lubricity, the rate of wear is not excessive. Therefore, the port head need not be shimmed, nor is precise alignment between the rotor assembly 7 and the port sleeve 13 necessary following replacement of the rotor or port sleeve, and such replacement may be easily accomplished in the field without the necessity of special alignment tools. Further, since the port sleeve 13 is removable, it is not necessary to replace the entire port head 15 when servicing is required.

Obviously, many modifications and variations of the present invention are possible in light of the above teachings. It is therefore to be understood that within the scope of the appended claims, the invention may be practiced otherwise than as specifically described herein.

What is claimed is:

1. A rotary liquid ring air compressor comprising:

a compressor housing;

a rotor assembly non-rotatably mounted on a shaft within said housing, said rotor assembly having a bore;

means for introducing liquid in said housing for creating a liquid ring during rotation of said rotor assembly;

means for rotating said shaft;

a port head mounted on said housing; and a port sleeve mounted on said port head and positionable in said bore, said port sleeve including means for reducing cavitation during start-up of said compressor under pressure.

2. The compressor of claim 1 wherein said means for reducing cavitation comprises at least two longitudinal slots on a surface of said port sleeve.

* * * * *